US006343974B1

(12) United States Patent
França et al.

(10) Patent No.: US 6,343,974 B1
(45) Date of Patent: Feb. 5, 2002

(54) REAL-TIME METHOD FOR PROFILING AND CONDITIONING CHEMICAL-MECHANICAL POLISHING PADS

(75) Inventors: Daniel L. França, Poughkeepsie; Raymond Khoury, Wappingers Falls; Jose M. Ocasio, Maybrook; Uldis A. Ziemins, Poughkeepsie, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/603,684

(22) Filed: Jun. 26, 2000

(51) Int. Cl.[7] ..... B24B 49/00

(52) U.S. Cl. ..... 451/9; 451/6; 451/10; 451/11; 451/56; 451/443

(58) Field of Search ..... 451/5, 6, 9, 10, 451/11, 12, 13, 56, 59, 63, 443

(56) References Cited

U.S. PATENT DOCUMENTS

| | | | | |
|---|---|---|---|---|
| 5,081,796 A | | 1/1992 | Schultz | |
| 5,216,843 A | | 6/1993 | Breivogel et al. | |
| 5,222,329 A | | 6/1993 | Yu | |
| 5,461,007 A | | 10/1995 | Kobayashi | |
| 5,527,424 A | | 6/1996 | Mullins | |
| 5,547,417 A | | 8/1996 | Breivogel et al. | |
| 5,611,943 A | | 3/1997 | Cadien et al. | |
| 5,664,987 A | | 9/1997 | Renteln | |
| 5,779,526 A | * | 7/1998 | Gill | 451/324 |
| 5,785,585 A | | 7/1998 | Manfredi et al. | |
| 5,801,066 A | | 9/1998 | Meikle | |
| 5,851,138 A | | 12/1998 | Hempel, Jr. | |
| 5,941,762 A | | 8/1999 | Ravkin et al. | |
| 5,954,570 A | * | 9/1999 | Yano et al. | 451/285 |
| 6,027,659 A | | 2/2000 | Billett | |
| 6,045,434 A | | 4/2000 | Fisher, Jr. et al. | |
| 6,120,350 A | * | 9/2000 | Zhou et al. | 451/21 |
| 6,196,899 B1 | * | 3/2001 | Chopra et al. | 451/56 |
| 6,217,422 B1 | * | 4/2001 | Franca et al. | 451/56 |
| 6,220,936 B1 | * | 4/2001 | Quek | 451/41 |
| 6,293,853 B1 | * | 9/2001 | Perlov et al. | 451/56 |

* cited by examiner

*Primary Examiner*—Eileen P. Morgan
(74) *Attorney, Agent, or Firm*—Ratner & Prestia; Tiffany L. Townsend, Esq.

(57) ABSTRACT

A conditioning tool including a rotary conditioning pad; a lower shaft attached to the conditioning pad; an upper shaft having an upper end and a lower end, the lower end attached to the lower shaft via a flexible coupling; and a motor attached to the upper end of the upper shaft and adapted to rotate the shaft. The tool further includes a mechanism for measuring an angle of the conditioning pad relative to a reference plane. The conditioning tool may further include a conditioning arm, various control mechanisms, and a controller for receiving feedback from the angle measuring mechanism and the various control mechanisms and for controlling the various control mechanisms in response to the feedback. A chemical-mechanical polishing apparatus and a conditioning method for providing a uniform polishing surface of a chemical-mechanical polishing pad are also disclosed.

16 Claims, 2 Drawing Sheets

REAL-TIME METHOD FOR PROFILING AND CONDITIONING CHEMICAL-MECHANICAL POLISHING PADS

TECHNICAL FIELD

The present invention relates generally to semiconductor manufacturing and, more specifically, to the conditioning of polishing pads used for chemical-mechanical polishing (CMP).

BACKGROUND OF THE INVENTION

Chemical-Mechanical Polishing (CMP) is a key processing technology for fabricating semiconductor chips. Often, after the performance of a processing step, the resulting wafer surface is full of peaks and valleys. Peaks and valleys of subsequent processing steps can build upon one another, creating an uneven surface that may be undesirable for a number of reasons. CMP uses a polishing pad and a slurry of chemically active liquid and abrasive material to grind down the surface of a wafer, thus restoring the planar surface.

In particular, CMP is useful for planarizing intermetal dielectric layers of silicon dioxide or for removing portions of conductive layers within integrated circuit devices. Non-planar dielectric surfaces may interfere with the optical resolution of subsequent photolithography processing steps, making it extremely difficult to print high-resolution lines. The application of a second metal layer over an intermetal dielectric layer having large step heights can result in inadequate metal coverage, and ultimately in an open circuit.

In an exemplary CMP process, the semiconductor wafer is held face down and rotated against a flat polishing pad that has been coated with the slurry. Both the wafer and the pad are typically rotated relative to each other. The abrasive polishing process continues until the surface of the wafer contacting the pad is substantially planar.

The motion of the wafer with respect to the polishing pad and the force applied to hold the wafer against the pad adds mechanical energy to the system that helps remove the wafer surface material. In addition, the process of supplying fresh chemical liquid and removing spent chemical liquid helps remove material from the wafer surface. Uniform removal of material from the surface of the wafer is pursued by adjusting a number of variables, such as the pad velocity with respect to the wafer surface, the force applied between the pad and the wafer, and the slurry composition and flow.

Over time, the initially rough surface of the polishing pad becomes worn and may glaze over due to a build-up of slurry and other deposits on the pad surface. To counteract the glazing and wear, the polishing pad is periodically mechanically scored or "conditioned." Conditioning the pad removes the build-up on the pad and roughens the surface of the pad. Different approaches to conditioning may be required depending on the hardness of the pad surface and the particular slurry used for polishing. Conditioning may be performed by a conditioning apparatus in a discrete conditioning step or during wafer polishing depending on the specific conditioning process and apparatus used.

In one type of conditioning process, a rotating conditioning pad having a diameter much smaller than the diameter of a rotating polishing pad is moved across the polishing pad by, for example, a robotic arm. A number of types of conditioning pads are known in the art. In particular, it is known to use a conditioning pad comprising the same material as the polishing pad, as disclosed in pending U.S. patent application Ser. No. 09/532,170, titled "Polishing Pad Reconditioning Via Polishing Pad Material As Conditioner," filed on Mar. 21, 2000, and assigned to the common assignee of the subject invention.

Measurements have found a direct correlation between the profile of the substrate and the pad polishing the substrate. For example, FIG. 1 shows a plot of the relative thickness of an exemplary polishing pad 10 after the pad has been used in a rotary CMP process over a period of time and has become worn differently in one region as compared with another. More wear is shown in regions 12 and 14 than in edge regions 16 or center region 18. The polishing rate and uniformity of the CMP process may be greatly affected by the characteristics of the polishing pad surface, which can make the slurry more or less effective.

Although conditioning of the polishing pad surface improves polishing uniformity and rates, it has the detrimental effect of removing a quantity of polishing pad material. Uneven wear in the polishing pad may be caused by characteristics of the wafers or the location on the pad of the wafers being polished, by non-uniformities introduced by the polishing tool, or by non-uniform removal of pad material during conditioning. Such uneven wear may adversely affect the useful lifetime of the pad.

Others have described a number of complex methods and apparatus for detecting or calculating changes in wear in the polishing pad and then adjusting the pad conditioning parameters accordingly. For example, U.S. Pat. No. 6,045,434, owned by the common assignee of the subject invention, describes a method whereby a non-intrusive measurement of change in the polishing pad thickness is taken in various locations, and the pad conditioning or polishing tool parameters are adjusted accordingly. The non-intrusive measurement system is described as an array of sensors aligned over the pad surface.

A need remains, therefore, to provide a novel apparatus and method for providing a uniform polishing pad surface without additional, fixed, non-intrusive measurement apparatus aligned over the pad surface.

SUMMARY OF THE INVENTION

To meet this and other needs, and in view of its purposes, the present invention provides a conditioning tool that achieves uniform conditioning of a chemical-mechanical polishing pad. The conditioning tool includes a rotary conditioning pad; a lower shaft attached to the conditioning pad; an upper shaft having an upper end and a lower end, the lower end attached to the lower shaft via a flexible coupling; and a motor attached to the upper end of the upper shaft and adapted to rotate the shaft. The tool further includes a mechanism for measuring an angle of the conditioning pad relative to a reference plane. The mechanism for measuring the angle of the conditioning pad may comprise a follower spaced apart from and attached to the conditioning pad that replicates the angle of the conditioning pad, and one or more proximity sensors supported above the follower. Three sensors may be used to determine the coordinates of the plane in which the follower lies.

The conditioning tool may further include a conditioning arm adapted to support the motor and to sweep the motor and attached conditioning pad across the polishing pad. Various control components, such as an element for controlling rotation speed of the motor imparted to the shaft, an element for controlling the radial position of the conditioning arm, and an element for controlling the pressure exerted by the conditioning pad against the polishing pad may be provided. A controller for receiving feedback signals from the proximity sensors and the various control components may also be included. The controller provides control signals to the various control components in response to the feedback signals.

The subject invention also encompasses a chemical-mechanical polishing apparatus comprising a polishing pad, a conditioning tool, and a mechanism for controlling the conditioning parameters of the conditioning tool relative to the polishing pad.

In a method for conditioning a polishing surface of a chemical-mechanical polishing pad in accordance with this invention, a first step comprises measuring a variation in height over the polishing surface using the conditioning tool. Next, the measured variation is analyzed to identify at least a first region in need of greater conditioning and a second region in need of lesser or no conditioning. Finally, the first and second regions are conditioned using at least one conditioning parameter in the first region that is different than in the second region to meet the need identified by the profile of the pad surface.

These steps may be repeated until the pad reaches a predetermined state of planarity. The different conditioning parameter may comprise the pressure exerted by the conditioning tool against the polishing pad, the rotation speed of the conditioning tool, the relative amount of time spent conditioning the polishing pad in the first region as compared to the second region, or a combination of these parameters. The method of the present invention may incorporate using the conditioning tool of the invention.

It is to be understood that both the foregoing general description and the following detailed description are exemplary, but are not restrictive, of the invention.

BRIEF DESCRIPTION OF DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF INVENTION

Figure 1:
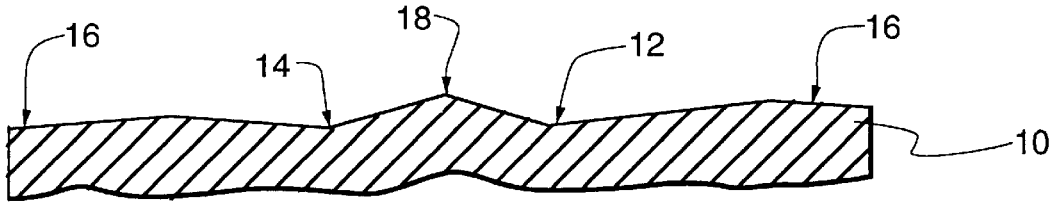
Fig. 1 (PRIOR ART)
FIG. 1 is a plot of the relative thickness of an exemplary polishing pad after use in a CMP process of the prior art.

Referring now to the drawing, in which like reference numbers refer to like elements throughout, FIGS. 2–5 show conditioning tool 20 of the present invention, designed to provide uniform conditioning of a chemical-mechanical polishing pad 22. As shown in detail in FIGS. 2 and 3, conditioning tool 20 comprises a rotary conditioning pad 24. Conditioning pad 24 is connected to a parallel follower 26 by struts 28 (two are shown for purposes of example).

A lower shaft 30 is attached to conditioning pad 24. An upper shaft 32 is connected at its lower end 33 to lower shaft 30 via a flexible coupling 34 and at its upper end 35 to a motor 36. Flexible coupling 34 may be any type of flexible coupling known in the art, for example but not limited to a ball and socket coupling. Motor 36 rotates upper shaft 32, which transmits rotation to lower shaft 30 through flexible coupling 34.

Figure 5:
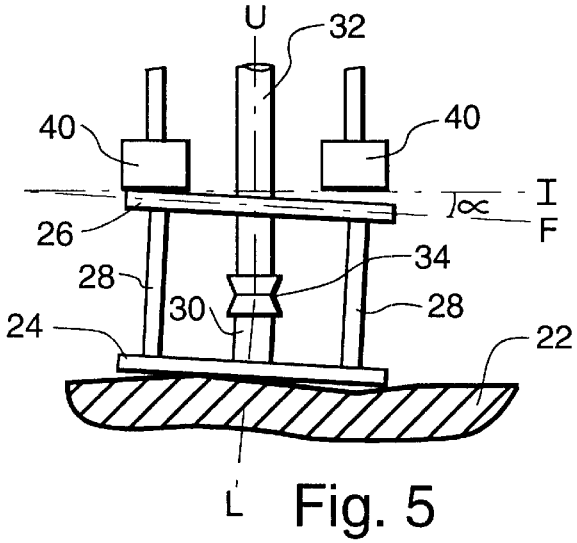
FIG. 5 is a side view of the tool shown in FIG. 2 in which the conditioning pad is angled relative to the upper shaft in response to the surface contour of the polishing pad.

Flexible coupling 34 allows lower shaft 30 and upper shaft 32, which are normally coaxial with one another, to flex out of axial alignment as conditioning pad 24 follows the contour of polishing pad 22, as shown in FIG. 5. Normally, axis "U" through upper shaft 32 and axis "L" through lower shaft 30 are coaxial and perpendicular to reference plane I, which is also normally parallel to conditioning pad 24 and follower 26. As shown in FIG. 5, however, when the contour of polishing pad 22 is angled from perpendicular to axis U, conditioning pad 24 follows the angled contour and becomes angled parallel to the plane "F" through follower 26 at an angle $\alpha$ to reference plane I.

When this situation happens, a plurality of proximity sensors 40 detect the change in the distance "d" (shown in FIG. 3) between each sensor and follower 26. Proximity sensors 40 may be any kind of proximity sensor known in the art, but preferably comprise optic or capacitance sensors. Although two proximity sensors spaced 180° apart are shown, a single proximity sensor or more than two proximity sensors may be used. Three proximity sensors may be provided to establish the coordinates of the plane in which follower 26 lies.

Figure 4:
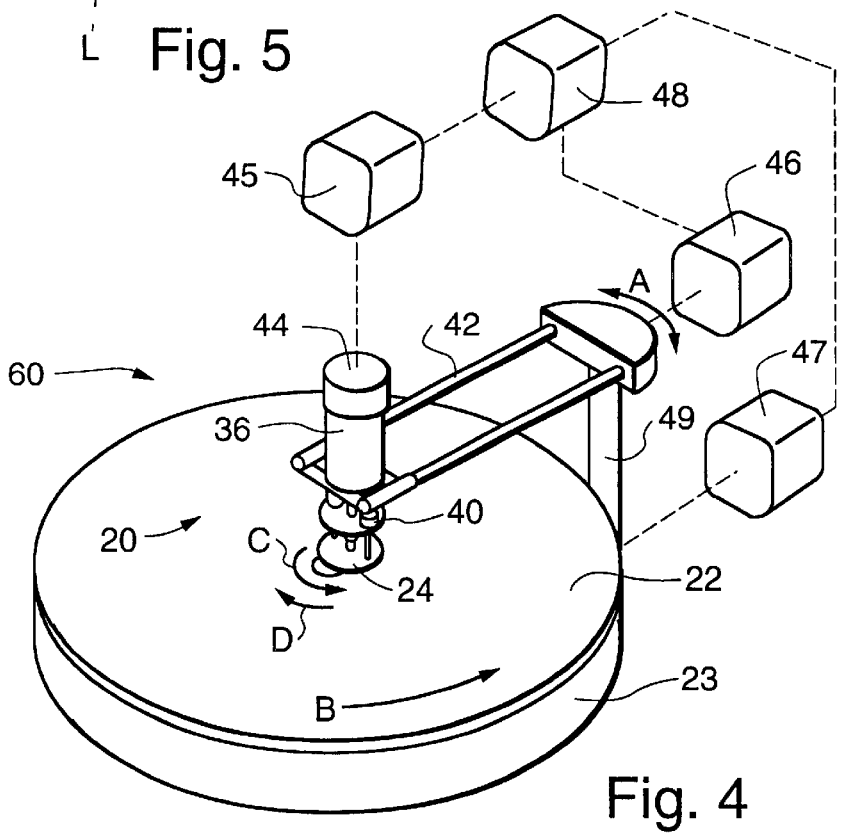
FIG. 4 is a perspective view of an exemplary CMP apparatus of the present invention comprising a conditioning tool of the present invention with the various control mechanisms shown schematically.
Figure 3:
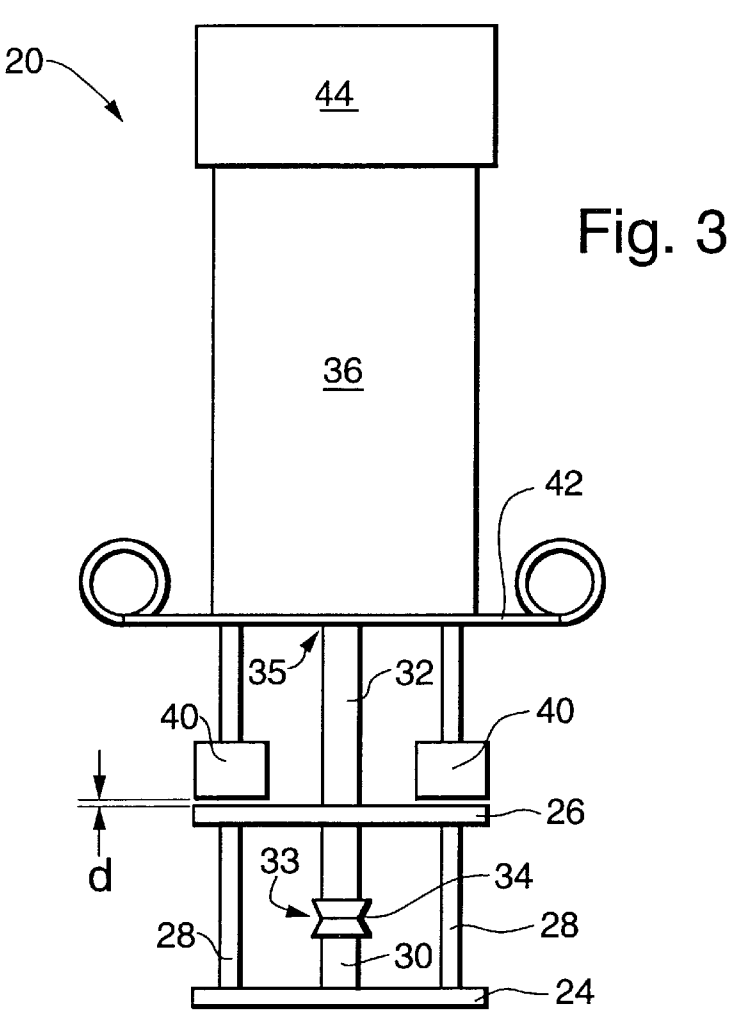
FIG. 3 is a side view of the tool shown in FIG. 2.
Figure 2:
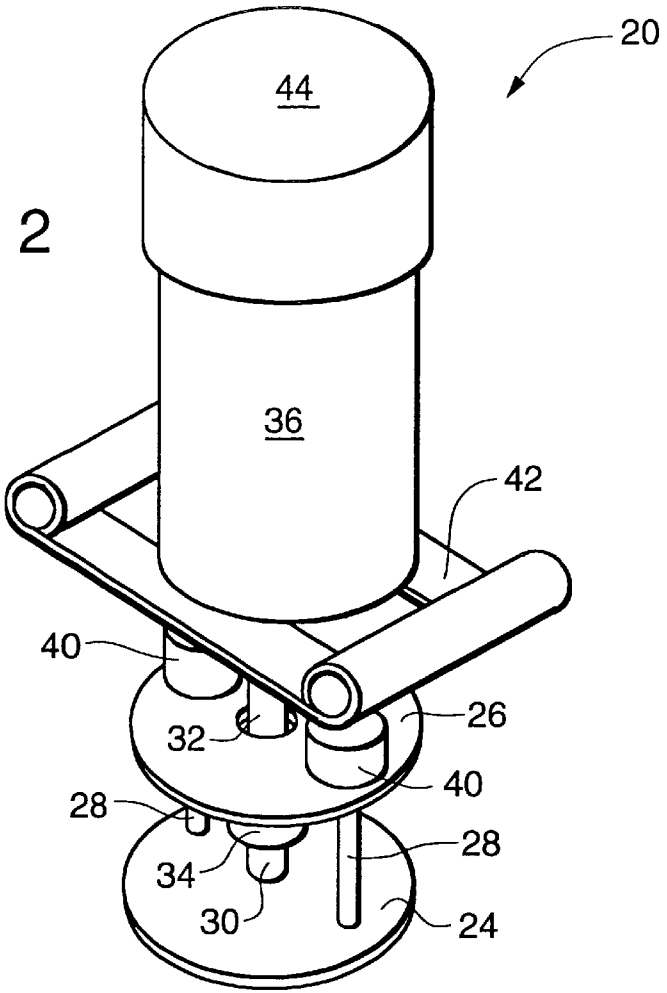
FIG. 2 is a perspective view of an exemplary conditioning tool of the present invention.

As shown in FIG. 4, conditioning tool 20 typically comprises a conditioning arm 42 adapted to support motor 36 and to sweep the motor and attached conditioning pad 24 across polishing pad 22 along arrow "A". Chemical-mechanical polishing apparatus 60, typical of those known in the art, comprises a polishing table 23 that rotates polishing pad 22 in the direction of arrow "B". Conditioning pad 24 may be rotated in the same direction as the rotation of the polishing pad along arrow "C", or against the rotation of the polishing pad along arrow "D".

A rotary encoder 44 typically provides a readout of the rotation speed imparted to upper shaft 32 by motor 36. A motor control mechanism 45 typically varies the speed of the motor. A sweep control mechanism 46 controls the radial position of conditioning arm 42. A pressure control mechanism 47 typically controls the pressure exerted by conditioning pad 24 against polishing pad 22. The various mechanisms may include such components as are known in the art, and may vary depending upon the make and model of conditioning tool 20.

Rotary encoder 44 and motor control mechanism 45 together comprise a rotation control mechanism and together provide feedback from and control to motor 36. Similarly, each of the other control mechanisms may comprise discrete devices to provide feedback and to provide control of the parameter desired. For simplicity, the term "control mechanism" is used to refer to both the feedback and control portion of the mechanism. The term "various control mechanisms" is used to refer to all such control mechanisms, including the rotation control mechanism, sweep control mechanism 46, and pressure control mechanism 47.

In particular, a Westech Conditioner, made by SpeedFam-IPEC of Chandler, Arizona, has a sweep control mechanism comprising a motor and cam arrangement in which the speed of the motor controls the speed of the sweep. The Westech Conditioner uses an inflatable bladder (not shown) to control the angle of the shaft 49 relative to vertical as a way to control the pressure exerted by conditioning pad 24. As shaft 49 is tilted toward polishing pad 22, the downward pressure increases. As shaft 49 is tilted away from polishing pad 22, the downward pressure decreases.

A controller 48, such as a microprocessor, receives feedback signals from proximity sensors 40, the rotation control mechanism, sweep control mechanism 46, and pressure control mechanism 47, as well as any other control devices providing feedback within the CMP tool. Controller 48 also sends control signals back to the rotation control mechanism, sweep control mechanism 46, and pressure control mechanism 47 and to any other control devices in response to the feedback signals. For instance, these control signals may instruct the rotation control mechanism (and, specifically, motor control mechanism 45) to increase or decrease the rotation speed of upper shaft 32, or instruct sweep control mechanism 46 to provide a longer period of time at the edge of polishing pad 22 rather than in the middle, or may instruct pressure control mechanism 47 to apply more pressure when the conditioner is at the edge rather than in the middle, or vice versa.

Thus, the method of the present invention for providing polishing pad 22 with a uniform polishing surface comprises first defining a surface contour of the polishing surface using a conditioning tool such as tool 20 described above that provides feedback from proximity sensors 40 to controller 48. That feedback identifies at least a first region in polishing pad 22 in need of greater conditioning, such as edge region 16 shown in FIG. 1, and a second region in need of lesser or no conditioning, such as region 14 shown in FIG. 1.

Typically, as conditioning pad 24 is swept across polishing pad 22 by conditioning arm 42, conditioning pad 24 will follow the polishing pad surface contour. This action will cause conditioning pad 24 to become angled relative to reference plane I at an angle $\alpha$ and will further cause lower shaft 30 to flex out of coaxial alignment with upper shaft 32 at flexible coupling 34. Follower 26 replicates angle $\alpha$ of conditioning pad 24, and thus proximity sensors 40, typically having micron sensitivity, can sense the angle of follower 26 relative to reference plane I and can provide a corresponding signal to controller 48.

Through output signals sent to the rotation control mechanism, sweep control mechanism 46, and pressure control mechanism 47, controller 48 then modifies at least one conditioning parameter of conditioning tool 20 to condition the first and second regions as necessary to meet the need sensed via proximity sensors 40. For example, the downward pressure exerted by conditioning tool 20 against polishing pad 22 can be increased or decreased, the rotation speed of upper shaft 32 can be increased or decreased, the relative amount of time that conditioning arm 42 spends in a particular radial position can be changed, or some combination of these parameters can be modified.

Any such modifications impact the degree of conditioning in a first region as compared to a second region.

The surface contour of the pad can continually be redefined and the conditioning parameters adjusted to meet any state of planarity or uniformity desired for polishing pad 22. The conditioning process can be continuously performed during an ongoing CMP process. Alternatively, the conditioning process can be performed between wafer polishing operations.

A comparison between typical performance of the improved conditioning method and tool of the present invention and a standard conditioning method and tool is provided in TABLE 1.

TABLE 1

| Tool | Mean | St. Dev. | Min | Max | Range |
|---|---|---|---|---|---|
| Standard | 2489.1 | 185.43 | 2204.4 | 2811.1 | 606.8 |
| Improved | 2456.0 | 78.46 | 2332.4 | 2582.1 | 249.7 |

TABLE 1 shows the thickness of statistical process control (SPC) wafers in microns as measured across 13 different locations. The row labeled "standard" provides the measurements for an SPC wafer that was polished with a polishing pad after conditioning by standard conditioning methods known in the art. The row labeled "improved" provides the measurements for an SPC wafer that was polished with the polishing pad after conditioning by the improved process of the present invention.

Although the mean thickness is relatively the same for both wafers (within 1.5% of one another), the standard deviation in thickness across the wafer polished by the pad conditioned by the improved conditioning method using the improved conditioning tool is 58% less than the standard deviation in thickness of the wafer polished by the pad conditioned by the standard method with a standard tool. Similarly, the range of thickness in the wafer polished by the pad conditioned by the improved method with the improved tool is 59% of the thickness of the wafer polished by the pad conditioned by the standard method using the standard tool. Thus, use of the method and tool of the present invention shows a marked improvement in the uniformity of the wafers polished by the polishing pads so conditioned.

Although illustrated and described above with reference to certain specific embodiments, the present invention is nevertheless not intended to be limited to the details shown. Rather, various modifications may be made in the details within the scope and range of equivalents of the claims and without departing from the spirit of the invention. Specifically, for example, the present invention is illustrated and described above with a conditioning pad 24 and follower 26, where sensors 40 measure the angle of deflection a for conditioning pad 24 by measuring proximity to follower 26. A conditioning tool may be provided, however, without such a follower. Instead, the conditioning tool may measure the angle of deflection directly at conditioning pad 24.

What is claimed:

1. A conditioning tool for providing uniform conditioning of a chemical-mechanical polishing pad, the conditioning tool comprising:

a rotary conditioning pad;

a lower shaft attached to the conditioning pad;

a flexible coupling;

an upper shaft having an upper end and a lower end, the lower end attached to the lower shaft via the flexible coupling;

a motor attached to the upper end of the upper shaft and rotating the shaft; and means for measuring an angle of the conditioning pad relative to a reference plane.

2. The conditioning tool of claim 1 wherein the means for measuring the angle of the conditioning pad comprises:

a follower spaced apart from and attached to the conditioning pad that replicates the angle of the conditioning pad; and at least one proximity sensor supported above the follower.

3. The conditioning tool of claim 2 wherein the at least one proximity sensor is an optic or a capacitance sensor.

4. The conditioning tool of claim 2 further comprising a conditioning arm supporting the motor and sweeping the motor and attached conditioning pad across the polishing pad.

5. The conditioning tool of claim 4 further comprising:

rotation control means for controlling rotation speed of the motor;

sweep control means for controlling the radial position of the conditioning arm;

pressure control means for controlling the pressure exerted by the conditioning pad against the polishing pad; and a controller for receiving feedback signals from the at least one proximity sensor, the rotation control means, the sweep control means, and the pressure control means, and for sending control signals to the rotation control means, the sweep control means, and the pressure control means in response to the feedback signals.

6. A conditioning tool for providing uniform conditioning of a chemical-mechanical polishing pad having a surface contour, the conditioning tool comprising:

a rotary conditioning pad;

a lower shaft attached perpendicular to the conditioning pad and having an axis;

a flexible coupling;

an upper shaft having an axis normally coaxially aligned with the lower shaft and having an upper end and a lower end, the lower end attached to the lower shaft via the flexible coupling, the flexible coupling permitting the lower shaft to flex out of coaxial alignment with the upper shaft as the conditioning pad follows the surface contour of the polishing pad;

a motor attached to the upper end of the upper shaft and rotating the shaft;

a reference plane perpendicular to the upper shaft axis, the conditioning pad normally parallel to the reference plane;

a follower spaced apart from, parallel to, and attached to the conditioning pad and normally coplanar with the reference plane, but having an angle relative to the reference plane when the upper and lower shafts are out of coaxial alignment;

at least one proximity sensor supported above the follower for measuring the angle of the follower relative to the reference plane;

a conditioning arm supporting the motor and sweeping the motor and attached conditioning pad across the polishing pad;

rotation control means for controlling rotation speed of the motor imparted to the upper shaft;

sweep control means for controlling the radial position of the conditioning arm;

pressure control means for controlling the pressure exerted by the conditioning pad against the polishing pad; and a controller for receiving feedback signals from the at least one proximity sensor, the rotation control means, the sweep control means, and the pressure control means, and for sending control signals to the rotation control means, the sweep control means, and the pressure control means in response to the feedback signals.

7. A chemical-mechanical polishing apparatus comprising a polishing pad, a conditioning tool for conditioning the polishing pad, and means for controlling the conditioning parameters of the conditioning tool relative to the polishing pad, the conditioning tool comprising:

a rotary conditioning pad;

a lower shaft attached to the conditioning pad;

a flexible coupling;

an upper shaft having an upper end and a lower end, the lower end attached to the lower shaft via the flexible coupling;

a motor attached to the upper end of the upper shaft and rotating the shaft; and means for measuring an angle of the conditioning pad relative to a reference plane.

8. The chemical-mechanical polishing apparatus of claim 7 wherein the means for measuring the angle of the conditioning pad comprises:

a follower spaced apart from and attached to the conditioning pad that replicates the angle of the conditioning pad; and at least one proximity sensor supported above the follower.

9. The chemical-mechanical polishing apparatus of claim 8 wherein the at least one proximity sensor is an optic or a capacitance sensor.

10. The chemical-mechanical polishing apparatus of claim 8 wherein the conditioning tool further comprises a conditioning arm supporting the motor and sweeping the motor and attached conditioning pad across the polishing pad.

11. The chemical-mechanical polishing apparatus of claim 10 wherein the means for controlling the conditioning parameters of the conditioning tool relative to the polishing pad includes:

rotation control means for controlling rotation speed of the motor;

sweep control means for controlling the radial position of the conditioning arm;

pressure control means for controlling the pressure exerted by the conditioning pad against the polishing pad; and a controller for receiving feedback signals from the at least one proximity sensor, the rotation control means, the sweep control means, and the pressure control means, and for sending control signals to the rotation control means, the sweep control means, and the pressure control means in response to the feedback signals.

12. A conditioning method for providing a uniform polishing surface of a chemical-mechanical polishing pad using a conditioning tool having at least one controller that controls at least one conditioning parameter, the method comprising the steps of:

(a) defining a surface contour of the polishing surface using the conditioning tool to provide feedback to the controller identifying at least a first region in need of greater conditioning and a second region in need of lesser or no conditioning; and (b) modifying at least one conditioning parameter of the conditioning tool wherein the conditioning tool has a conditioning pad and step (a) comprises measuring an angle of the conditioning pad relative to a reference plane when the conditioning pad is in contact with the polishing pad.

13. The conditioning method of claim 12 further comprising repeating steps (a) and (b) until the pad reaches a predetermined state of planarity.

14. The conditioning method of claim 12 wherein step (b) comprises modifying a conditioning parameter selected from the group consisting of pressure exerted by the conditioning tool against the polishing pad; rotation speed of the conditioning tool; relative amount of time spent conditioning the polishing pad in the first region as compared to the second region, and a combination of such conditioning parameters.

15. The conditioning method of claim 12 wherein the conditioning tool comprises a rotary conditioning pad; a lower shaft attached perpendicular to the conditioning pad and having an axis; an upper shaft having an axis normally coaxially aligned with the lower shaft and having an upper end and a lower end, the lower end attached to the lower shaft via a flexible coupling; a motor attached to the upper end of the upper shaft and adapted to rotate the upper shaft; a follower spaced apart from and attached to the conditioning pad; at least one proximity sensor supported above the follower; a conditioning arm adapted to support the motor and to sweep the motor and attached conditioning pad across the polishing pad; rotation control means for controlling rotation speed of the motor imparted to the upper shaft; sweep control means for controlling the radial position of the conditioning arm; pressure control means for controlling the pressure exerted by the conditioning pad against the polishing pad; and a controller for receiving feedback signals from the at least one proximity sensor, the rotation control means, the sweep control means, and the pressure control means; the method further comprising, in step (a):

(a)(i) sweeping the conditioning pad across the polishing pad with the conditioning arm;

(a)(ii) with the conditioning pad following the polishing pad surface contour, causing the conditioning pad to become angled relative to a reference plane perpendicular to the upper shaft axis and further causing the lower shaft to flex out of coaxial alignment with the upper shaft at the flexible coupling;

(a)(iii) angling the follower relative to the reference plane at the same angle to which the conditioning pad is angled relative to the reference plane; and (a)(iv) sensing via the proximity sensors the angle of the follower relative to the reference plane and providing a corresponding signal to the controller; and in step (b), adjusting via the controller a control signal to one of the rotation control means, the sweep control means, the pressure control means, or a combination thereof, to provide a different degree of conditioning in the first region as compared to the second region.

16. The conditioning method of claim 15 wherein providing the different degree of conditioning comprises adjusting one or more conditioning tool parameters selected from the group consisting of pressure exerted by the conditioning tool against the polishing pad; rotation speed of the conditioning tool; and relative amount of time spent conditioning the polishing pad in the first region as compared to the second region.

* * * * *